US006709687B2

(12) United States Patent
Pockat et al.

(10) Patent No.: US 6,709,687 B2
(45) Date of Patent: Mar. 23, 2004

(54) ANTI-TRANSFER FILM AND PACKAGE

(75) Inventors: Gregory Robert Pockat, Ripon, WI (US); Richard Musil, Vacaville, CA (US); Andrea M. Carlson, Oshkosh, WI (US); Kevin Nelson, Appleton, WI (US)

(73) Assignee: Curwood, Inc., Oshkosh, WI (US)

( * ) Notice: Subject to any disclaimer, the term of this patent is extended or adjusted under 35 U.S.C. 154(b) by 50 days.

(21) Appl. No.: 09/847,250

(22) Filed: May 2, 2001

(65) Prior Publication Data

US 2002/0039610 A1 Apr. 4, 2002

Related U.S. Application Data

(60) Provisional application No. 60/201,355, filed on May 2, 2000.

(51) Int. Cl.[7] ..... A23B 4/03; B32B 27/32

(52) U.S. Cl. ..... 426/127; 426/129; 426/130; 426/415; 428/515; 428/516; 428/520; 428/213; 428/215; 428/34.6

(58) Field of Search ..... 426/127, 129, 426/130, 415; 428/515, 516, 520, 213, 215, 34.6

(56) References Cited

U.S. PATENT DOCUMENTS 5,037,662 A * 8/1991 Poulose et al. ..... 426/52
5,110,609 A 5/1992 Lewis et al. ..... 426/402
5,523,136 A * 6/1996 Fischer et al. ..... 426/127
5,858,446 A * 1/1999 Lewis et al. ..... 426/615
5,962,092 A * 10/1999 Kuo et al. ..... 428/218
6,046,254 A * 4/2000 Kneale ..... 428/516

OTHER PUBLICATIONS

"Microbiology." 1988 McGraw–Hill. pp. 5–10 and 16. 7 sheets.
"Curlam Grade 1830–G." Jan. 2, 1998. Product Literature. 1 sheet.

* cited by examiner

*Primary Examiner*—D. Lawrence Tarazano
(74) *Attorney, Agent, or Firm*—Wilhelm Law Service; Thomas D. Wilhelm

(57) ABSTRACT

A generally transparent flexible packaging structure having an anti-transfer layer which, in a closed and sealed package, is at or close to an interior surface of the package. A contained food product in the package has a tendency to deposit a food product component on the interior surface of the packaging material and to thereby have a visually obscuring affect on transparency of the packaging structure. Anti-transfer material in the anti-transfer layer migrates to the interior surface of the package and interacts with the visually-obscuring component of the contained food product, thereby to attenuate or eliminate the visually obscuring effect of such component. Preferred primary polymer in the anti-transfer layer is EVA. Preferred anti-transfer materials include fatty acid esters and other amines and derivatives. The invention includes certain aspects of multiple layer packaging structures, closed and sealed packages, and methods of packaging food product.

26 Claims, 4 Drawing Sheets

FIG. 5
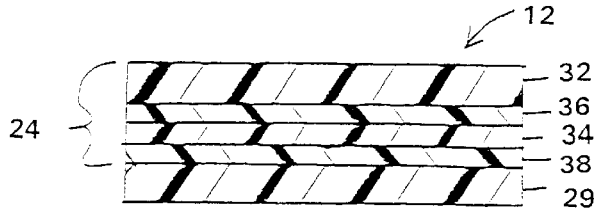
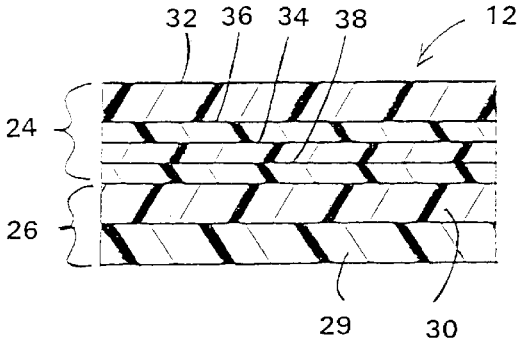
FIG. 6
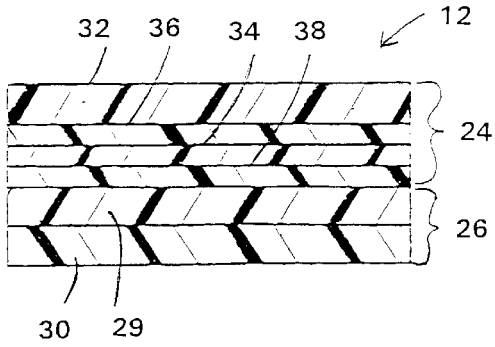
FIG. 7

ANTI-TRANSFER FILM AND PACKAGE

BACKGROUND

The present invention relates to multiple layer flexible packaging materials and to closed and sealed packages containing food product in such flexible packaging material.

Packagers design clear windows in packaging material to enable customers to have a clear visual image of the food product contained in the package. Any accumulation of material on the inner surface of the packaging structure impedes the clarity of the image which can be viewed.

Material can accumulate on an inner surface of the package in at least two ways. First, where the water activity of the food product in the package is 1.0, namely relative humidity of 100 percent, water can condense, out of the gaseous atmosphere in the package, onto the inner surface of the packaging material. Second, materials which are part of the contained product can transfer to the packaging structure as the product comes into contact with the packaging structure. Namely, material can rub off the product, can be transferred by abrasion, or product content can, for example and without limitation, have a selective affinity for the packaging material more so than for other ingredients of the product. Whatever the mechanism of transfer, material transferred to the packaging structure at the transparent window generally works against the objective of providing a clear window through which the product can be viewed.

Where obscurement is by condensation of liquid on the packaging structure from a moisture saturated environment inside the package, namely where water activity is 1.0, it is known to provide a surfactant or other anti-fog material at the inner surface of the packaging structure. Such anti-fog structure is believed to modify the surface tension of the moisture droplets so as to attenuate the obscuring affect of such condensation on the inner surface of the packaging structure.

However, where the water activity of the product is less than 1.0, namely about 0.4 to about 0.95, moisture generally does not condense on the inner surfaces of the packaging structure because of inadequate moisture in the package to support such condensation.

Still, in packaging some products such as jerky, where the water activity is less than 0.95, after packaging the product, a material deposit develops on the inner surface of the packaging structure, which material deposit attenuates the clarity of the visual image of the contained product.

It is an object of the invention to provide, at the inner surface of the packaging structure, anti-transfer material which attenuates transfer of food product extract to the packaging structure.

It is another object to provide a closed and sealed package, having a food product contained therein, wherein an anti-transfer material at inner surfaces of the package attenuates transfer of food product extract from the food product to the packaging structure.

It is yet another object to provide a multiple layer flexible packaging structure wherein an anti-transfer material at a surface of the packaging structure is capable of attenuating transfer of food product extract from a food product to the packaging structure.

SUMMARY

This invention comprehends a generally transparent flexible packaging structure having an anti-transfer layer which, in a closed and sealed package, is at or close to an interior surface of the package. A contained food product in the package has a tendency to deposit an e.g. fat, sugar, water or other component on the interior surface of the flexible packaging material and to thereby have a visually obscuring affect on the transparency of the packaging structure. Anti-transfer material in the anti-transfer layer migrates to the interior surface of the package and interacts with the visually-obscuring component of the contained food product, thereby to attenuate or eliminate the visually obscuring affect of such component.

In a first family of embodiments, the invention comprehends a closed and sealed package. The package comprises a flexible packaging structure comprising at least two layers and defining a closed and sealed containment structure. The flexible packaging structure comprises a substrate comprising one or more layers of polymeric material and an anti-transfer layer comprising a film-forming polymeric composition containing about 0.4 percent by weight to about 3 percent by weight of an anti-transfer material; and a contained food product in the closed and sealed package. The food product has a water activity in the closed and sealed package of about 0.4 to about 0.95 whereby relative humidity inside the package is less than 100 percent. The food product has a tendency to deposit a visually obscuring component thereof on the flexible packaging structure when in contact with the flexible packaging structure. The anti-transfer material is effective in the flexible packaging structure, upon contact of the food product with the packaging structure, to attenuate the visually obscuring affect of the visually obscuring component of the food product.

In preferred embodiments, the anti-transfer material is dispersed within the composition of the anti-transfer layer.

Further to preferred embodiments, the anti-transfer material is selected from the group consisting of primary alcohols having molecular weight greater than 200, polyethylene glycol, polypropylene glycol, glycerol, ethoxylated alcohols, glycerol monostearate, glycerol monooleate, esters of adipic acid, sorbitan monolaurate, sorbitan monooleate, ethoxylated sorbitan monolaurate, cocoamine, tallow amine, stearyl amine, ethoxylated stearyl amine, microcrystalline wax, carnauba wax, montan ester waxes, and polyethylene having molecular weight less than 4000.

In preferred embodiments, especially for interacting with fat components of the food product, the anti-transfer material comprises a short chain fatty acid or fatty acid derivative having a 12-carbon to 22-carbon chain.

In preferred embodiments, the anti-transfer material is dispersed in the anti-transfer layer, and is operative to migrate from within the anti-transfer layer to an interior surface of the packaging structure and to form an effectively protective coating on the interior surface of the packaging structure.

In highly preferred embodiments, the anti-transfer layer comprises ethylene vinyl acetate copolymer as a primary polymer.

In certain embodiments, the anti-transfer layer is comprised in a seal composite, wherein a primary polymer in the anti-transfer layer comprises ethylene vinyl acetate copolymer and wherein the seal composite further comprises a second layer comprising a second different ethylene-based polymer composition and wherein the second layer of the seal composite is tougher than the anti-transfer layer.

In preferred embodiments, the anti-transfer material is effective to attenuate the visually obscuring affect of at least one of fat, sugar, and water at water activity of about 0.4 to about 0.95.

In a second family of embodiments, the invention comprehends a multiple-layer anti-transfer film about 3.5 to about 8 mils thick. The film comprises a first substrate layer on a first surface of the film. The first substrate layer comprises an olefin-based polymer as a primary component thereof. The first substrate layer comprises about 16 weight percent to about 33 weight percent of the anti-transfer film. The anti-transfer film further comprises a polymeric seal composite comprising about 50 weight percent to about 70 weight percent of the anti-transfer film. The seal composite comprises a polymeric, olefin-based anti-transfer layer. The anti-transfer layer has about 0.4 weight percent to about 3 weight percent of an anti-transfer material generally dispersed through a thickness thereof. The anti-transfer layer is effective, upon contact with a food product in a closed and sealed package, and wherein the food product has a tendency to deposit a visually obscuring component thereof on an enclosing polymeric packaging structure, to attenuate the visually obscuring affect of the visually obscuring component.

In a third family of embodiments, the invention comprehends a method of packaging a food product. The method comprises providing, for packaging, a food product having a water activity in a closed and sealed package, of about 0.4 to about 0.95; and packaging the food product in a closed and sealed package comprising a flexible packaging structure, the flexible packaging structure comprising at least two layers and including (i) a substrate comprising one or more layers of polymeric material, and (ii) an anti-transfer layer comprising a film-forming polymeric composition containing about 0.4 percent by weight to about 3 percent by weight of an anti-transfer material dispersed within the composition of the anti-transfer layer. The food product has a tendency to deposit a visually obscuring component on the flexible packaging structure when in contact with the flexible packaging structure, and the anti-transfer material is effective in the flexible packaging structure, upon contact with the food product, to attenuate the visually obscuring affect of the visually obscuring component of the food product.

BRIEF DESCRIPTION OF THE DRAWINGS

FIG. 5 shows a cross-section of a fourth, five-layer, packaging structure of the invention incorporating the anti-transfer material.

FIG. 6 shows a cross-section of a fifth, six-layer, packaging structure of the invention incorporating the anti-transfer material.

FIG. 7 shows a cross-section of a sixth, six-layer, packaging structure of the invention incorporating the anti-transfer material.

Figure 1:
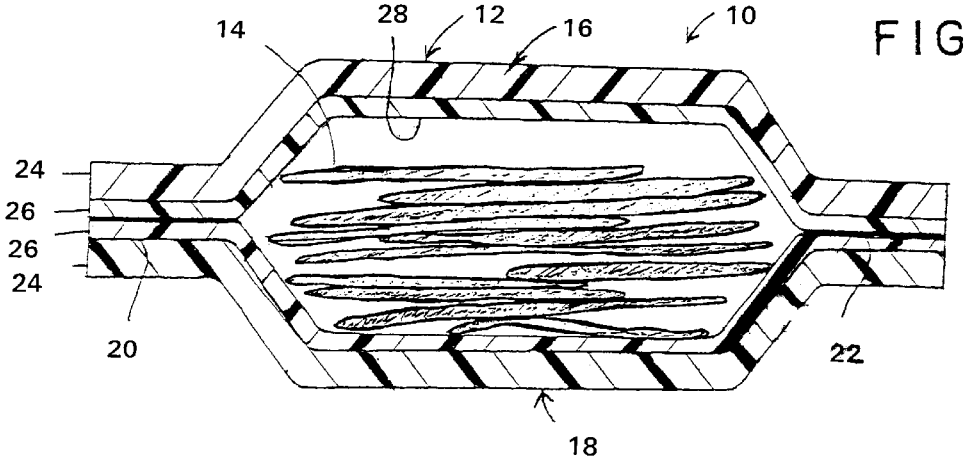
FIG. 1 shows a cross-section of a closed and sealed package, containing a food product packaged therein, and including anti-transfer material of the invention.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

Referring now to the drawings, FIG. 1 shows a cross-section of a package 10 of the invention, including flexible packaging structure 12 and contained jerky product 14. Packaging structure 12 includes an upper structure 16 and a lower structure 18. As seen there, package 10 illustrates a closed package sealed at end seals 20, 22, and made with primarily polymeric packaging materials. In general, it is preferred that both upper and lower structures 16, 18 be fabricated from the same packaging material, and that the upper and lower structures be comprised in a single unitary packaging structure element. However, the upper and lower structures can be separate packaging structures e.g. joined about a continuous periphery of the package, whereupon the upper and lower packaging structures can comprise different but cooperating structures. Given such possibilities, and opting for less complexity in the description, except where otherwise stated, the embodiments illustrated herein assume that both upper and lower structures are defined by a single, common packaging material, whereby the layer structuring and compositions of structures 16, 18 are the same for a given package unit.

Packaging materials other than polymeric materials can be used in the packaging structure, but generally at least a portion of the area of the packaging structure is visually transparent, for viewing the contained product through the packaging structure. Thus, for example, metal and/or paper or other cellulosic layers can be employed in patterns wherein a portion of the area of the packaging structure is retained devoid of such obscuring materials, whereby a transparent window can be employed in packages made with such structures.

Figure 2:
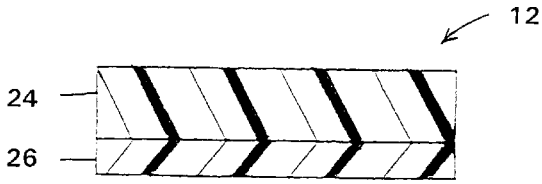
FIG. 2 shows a cross-section of a first packaging structure of the invention incorporating the anti-transfer material.

Referring to FIGS. 1 and 2, packaging structure 12 includes a packaging substrate 24 secured to a modified olefin seal composite 26 which is employed in FIGS. 1 and 2 in a heat seal capacity. The securement between substrate 24 and seal composite 26 can be obtained by e.g. mutual affinity of facing surfaces of substrate 24 and seal composite 26 for each other. In the alternative, an adhesive such as a urethane adhesive (not shown in FIG. 1) can be employed for securing substrate 24 to seal composite 26.

The packaging concepts described here are directed toward packaging and protecting food products which are generally semi-dry. Jerky, for example, typically contains about 20 weight percent to about 30 weight percent water, and exhibits a water activity of about 0.7. Such product is relatively hard, though generally not brittle. However, because of the hardness of the product, a certain degree of toughness is desired in the packaging material so that the food product does not penetrate or otherwise damage the packaging.

A typical packaging structure 12 contemplated for packaging jerky has an overall thickness of about 0.0035 inch (3.5 mils) to about 0.0065 inch (6.5 mils), preferably about 0.004 inch (4 mils) to about 0.0055 inch (5.5 mils). In the preferred thicknesses, seal composite 26 typically is at least about 0.0013 inch (1.3 mils), and can be substantially greater than 1.3 mils, depending on specifics of the anticipated use environment. Preferred thickness for seal composite 26 is about 1.3 mils to about 3.5 mils.

Seal composite 26 may comprise a single layer of polymeric material. However, preferred seal composite 26 comprises at least two layers which operate to provide a desired level of heat seal strength and physical toughness at or adjacent the interface of product and packaging material. The package thus can rely on a combination of layers or layer elements to form the seal composite referred to as 26, which does have the capacity to develop both the desired seal strength in heat sealing to itself, and the desired physical toughness at or adjacent the packaging-product interface.

Figure 3:
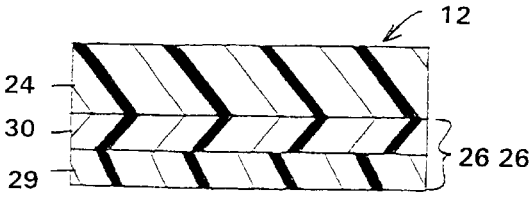
FIG. 3 shows a cross-section of a second packaging structure of the invention incorporating the anti-transfer material.
Figure 4:
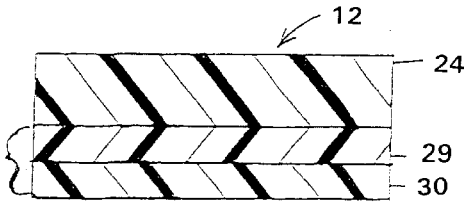
FIG. 4 shows a cross-section of a third packaging structure of the invention incorporating the anti-transfer material.

FIGS. 2, 3, and 4 illustrate substrate 24 as a single layer, which is acceptable in some use environments. However, substrate 24 typically comprises a number of layers which, in combination, address packaging issues such as toughness, impact resistance, moisture resistance, oxygen transmission, and the like. As illustrated hereinafter, substrate 24 comprises a wide range of multiple layer configurations embodying a wide range of polymeric and other materials. Indeed, while the invention contemplates a substrate 24, the range of possible substrate structures is so vast that the invention operates generally without regard to the particular composition and structure employed for substrate 24. However, the scope of the invention is defined in terms of flexible packaging structures having overall thickness of no more than about 0.008 inch (8 mils).

The focus of the invention is directed toward seal composite 26, and layers which cooperate with seal composite 26 in defining the attributes of the inner surface 28 of the package (FIG. 1). To that end, seal composite 26 generally comprises an anti-transfer layer 29 comprising an olefin-based polymeric composition. As illustrated in, for example, FIG. 3, anti-transfer layer 29 is typically used as the interior surface layer in the package, and thus also functions in a heat seal capacity. Accordingly, polymers preferred for use in anti-transfer layer 29 are selected from among those materials capable of forming good heat seals, such as the olefin family of polymers and copolymers.

As the olefin on which the composition of anti-transfer layer 29 is based, e.g. the primary polymer, there can be mentioned, for example and without limitation, low density polyethylene, linear low density polyethylene, ultra low density polyethylene, very low density polyethylene, medium density polyethylene, high density polyethylene, ethylene vinyl acetate copolymer, ionomer, and blends of such materials.

In addition to the olefin-based polymeric composition, anti-transfer layer 29 comprises an anti-transfer material mixed with the olefin-based polymer. Thus, the primary polymer selected for use in anti-transfer layer 29 must, in addition to performing a heat seal function, also be compatible with all functions inherent in receipt, dispersal, and retention, of the anti-transfer material into and within the interior of the anti-transfer layer, ready for use as well as with release of the anti-transfer material from the interior of the anti-transfer layer in a closed and sealed package, for migration and transport to interior surface 28.

As used herein, the phrase "primary polymer" means the carrier polymer into which the anti-transfer material or anti-transfer concentrate is blended in layer 29. The primary polymer can be a single polymer species, or a combination of polymers mixed or otherwise combined with each other, distinct from the anti-transfer material or anti-transfer concentrate.

In general, anti-transfer materials used herein comprise fatty acids, or fatty acid derivatives, having carbon chains 12 to 22 carbon atoms long, and may optionally contain polar elements such as carboxylic acids or carboxylic acid derivatives.

While choosing to not be bound by theory, the inventors herein contemplate that the non-polar portions of the anti-transfer material form loose associations with non-polar, generally organic portions of the product elements, such as animal fat, which can otherwise form deposits on the packaging structure. The inventors further contemplate that such associations are instrumental in effecting the observed attenuation of the otherwise negative affects of such deposition of product elements.

The inventors still further contemplate that the anti-transfer material may form a somewhat mobile layer at surface 28 which prevents the respective product elements from reaching intimate contact with the packaging structure, and that such deterred contact is effective to attenuate the otherwise negative visual effects.

Correspondingly, polar elements of the anti-transfer material, such as carboxylic groups or derivatives may associate with polar elements of the product, such as water, thereby to disperse such polar elements on the packaging structure. Indeed, there may be advantageous interaction between dispersed polar product extracts and non-polar product extracts, all in combination with the anti-transfer material on interior surface 28 of the packaging structure, thereby to produce a cocktail effect including the anti-transfer material, polar product extracts, and non-polar product extracts. In any event, and however, the anti-transfer material works, the end result is that the interior surface of the packaging film is not visually occluded by product extracts depositing on the interior surface of the packaging structure or such visual occlusion is substantially attenuated.

Table 1 illustrates examples of classes of compositions which can be used as anti-transfer materials.

TABLE 1

| Anti-transfer Agent Class | Examples | Exemplary Trade Names |
|---|---|---|
| alcohols and derivatives | primary alcohols with MW > 200; polyethylene glycol, polypropylene glycol, glycerol, ethoxylated alcohols. | UNILIN |
| fatty acid esters | glycerol derivatives, e.g. glycerol monostearate and glycerol monooleate, esters of adipic acid. | ATMER |
| sorbic acid esters and derivatives | sorbitan monolaurate, sorbitan monooleate, ethoxylated sorbitan monolaurate. | SPAN, TWEEN |
| amines and derivatives | cocoamine, tallow amine, stearyl amine, ethoxylated stearyl amine. | KEMAMINE; ATMER |

TABLE 1-continued

| Anti-transfer Agent Class | Examples | Exemplary Trade Names |
|---|---|---|
| waxes | polyethylene MW < 4000, microcrystalline wax, carnauba wax, montan ester waxes. | A-C; POLYWAX |
| silicones | poly(dimethyl siloxane) and derivatives | DOW-CORNING |

Anti-transfer layer 29 can also include other materials in amounts corresponding to processing aids and additives, for example slip additives and anti-block additives, as are conventionally used in seal layers and like compositions.

A preferred anti-transfer layer composition, for e.g. layer 29, is made as follows. A solid concentrate of the anti-transfer material is made by mixing together about 80 to about 90 weight percent, e.g. about 85 weight percent, of a carrier polymer such as ethylene methacrylic acid copolymer (EMAA), which is a solid polymer resin, and about 20 to about 10 weight percent, e.g. about 15 weight percent, of an anti-transfer material which is typically available in liquid form. An exemplary ethylene methacrylic acid copolymer is available from DuPont Company, Wilmington, Del., under the designation Nucrel® 903HC. An exemplary anti-transfer material is available from Ciba Specialty Chemicals, Basel Switzerland, as Atmer® 645 which is a mixture of nonionic surfactants.

Any polymer which can receive and hold the anti-transfer material, which polymer is compatible with dispersal of the anti-transfer material therein, and subsequent release of the anti-transfer material, can be used as the base resin of the concentrate. Such polymer must be compatible with extrusion processes, and must be compatible with the primary polymer of layer 29, into which the concentrate is compounded e.g. in the process of extruding layer 29.

The solid concentrate is preferably made by melting the solid polymeric resin in a mixing extruder, adding the liquid anti-transfer material to the melted polymeric resin in the mixing extruder, extruding, quenching, and pelletizing the mixture so made, thereby to obtain a pelletized solid anti-transfer concentrate which comprises about 15 weight percent anti-transfer agent and about 85 weight percent concentrate carrier polymer such as ethylene methacrylic acid copolymer.

The concentrate is then mixed with a primary sealant layer polymer such as, for example and without limitation, ethylene vinyl acetate copolymer (EVA). One such suitable EVA resin is identified as PETROTHENE® NA 442-051, which is 95 weight percent ethylene, and which is available from Equistar, Houston, Tex. Another acceptable EVA resin, also 95 weight percent ethylene, is ExxonMobil ESCORENE® 306.38, available from ExxonMobil Corporation, Houston, Tex. Acceptable linear low density polyethylene resins are, for example and without limitation, Exceed® 350D60 resin, available from ExxonMobil Corporation, and Eastman SC 74809X resin, available from Eastman Chemical Company, Kingsport, Tenn.

While a range of materials can be selected for use as the primary anti-transfer layer polymer, such polymer must be compatible with receiving thereinto the selected anti-transfer material or anti-transfer concentrate and dispersal of the anti-transfer material or anti-transfer concentrate within such primary polymer. The primary polymer must also be compatible with release of the anti-transfer material, and migration of the anti-transfer material to inner surface 28 of the package. The interactions of the concentrate polymer and the primary anti-transfer layer polymer, with the anti-transfer material determines, at least in part, the collective selections of materials for layer 29, as well as the relative quantities of the respective materials.

As an alternative to preparing an anti-transfer concentrate, the anti-transfer material can be injected into the extruder processing the primary polymer of the anti-transfer layer, or otherwise added to the primary polymer of the anti-transfer layer, whereby the concentrate need not be fabricated.

Given the above parameters, a variety of olefin-based polymers can be used as the primary polymer in the anti-transfer layer. Ethylene-based polymers are especially useful, and at least some anti-transfer benefit can be obtained by use of any of a wide range of ethylene-based polymers. The most desirable such polymers are the ethylene vinyl acetates (EVA), especially those EVA's which have high fractions of ethylene such as at least 85 weight percent ethylene, preferably at least 90 weight percent ethylene. Accordingly, such EVA polymers are especially preferred as the primary polymer in the anti-transfer layer.

A typical ratio of concentrate to e.g. EVA polymer in the anti-transfer layer is about 10 to 15 percent by weight concentrate to about 90 to about 85 percent by weight EVA, e.g. 12 weight percent concentrate and 88 weight percent EVA. The overall concentration, then, of anti-transfer additive in the composition of layer 29 is about 1 percent by weight to about 3 percent by weight additive. The concentrate and primary polymer can be mixed e.g. as solid pellets of the respective materials and the mixture extruded through an extruder to form a film, or a layer of a coextruded film.

The resulting layer, whether a single layer film or as a layer of a multiple layer coextruded film, generally corresponds to anti-transfer layer 29 or seal composite 26. Such anti-transfer layer 29 or seal composite 26 can be, for example and without limitation, fabricated using cast extrusion, blown film extrusion, or any other extrusion process with which the specific materials are compatible.

The layer or layers resulting from such coextrusion can then be joined with other separately fabricated layers by, for example, laminating such layers to seal composite 26, optionally at anti-transfer layer 29. FIG. 3 shows, for example, a support layer 30 of olefinic composition between substrate 24 and anti-transfer layer 29. The composition of support layer 30 in FIG. 3 is selected from materials which will adhere well to both anti-transfer layer 29 and substrate 24. The composition of such support layer can be, for example, the same as the primary polymer in the anti-transfer layer. In the embodiments illustrated in FIG. 3, support layer 30 preferably provides physical support to anti-transfer layer 29, adding to the physical toughness of the seal composite. In that regard, the composition of layer 30 is selected for properties of toughness, puncture resistance, bending tolerance, and the like.

In addition, the composition of layer 30 is also optionally and preferably selected for heat seal properties compatible with heat seal properties of layer 29, and the thermal properties of the other layers of the packaging structure, such that layer 30 supports formation of heat seals at surface 28.

Support layer 30 can be joined to anti-transfer layer 29 by, for example, coextrusion with anti-transfer layer 29, extrusion lamination of layer 30 to anti-transfer layer 29, adhesive lamination such as in a dry bond lamination process, or the like. The above illustrates that a wide range of materials can be used for support layer 30, and can be applied to anti-transfer layer 29 using a variety of processes to create the seal composite defined by the combination of layers 29 and 30.

Support layer 30 can be employed to accomplish any of a variety of objectives. As used herein, layer 30 is preferably used to strengthen the capability of antiptransfer layer 29 to fabricate heat seals, such as the seals 20, 22 in the package of FIG. 1. Such use contemplates that a seal fabricated using layer 29 alone may not have the desired level of strength. Accordingly, especially where layer 29 is relatively thin, a back-up seal assist layer, as at support layer 30, can be used e.g. to increase the strength of the seals 20, 22 formed where the anti-transfer layer surfaces are joined at inner surfaces 28.

In the alternative, or in combination, it may be desirable that anti-transfer layer 29 be relatively thin when considering the need for abuse resistance at interior surface 28, whereby the composition and thickness of support layer 30 are selected in large part so as to provide for the desired level of abuse resistance in support of anti-transfer layer 29. In any of the embodiments employing support layer 30, anti-transfer material can be incorporated into support layer 30 in addition to the already-noted incorporation of anti-transfer material into anti-transfer layer 29.

FIG. 4 shows a structure related to that of FIG. 3 in that the FIG. 4 structure includes a substrate 24, anti-transfer layer 29, and a support layer 30. The difference in FIG. 4 is that, while layer 30 was between the anti-transfer layer 29 and the substrate in FIG. 3, in FIG. 4 the anti-transfer layer is between the support layer and the substrate, whereby support layer 30, as part of heat seal composite 26, bears the primary function of forming heat seals 20, 22. The advantage of the FIG. 3 structure is that the additive anti-transfer material is in the surface layer where the anti-transfer material can implement the desired properties of the inner surface of the package by migrating to the surface of the layer which is used to contain the anti-transfer material in the packaging structure, whereby the anti-transfer material is arguably most available for migration to inner surface 28 of the packaging structure.

In FIG. 4, in order to implement the desired surface properties at inner surface 28, the anti-transfer material first migrates to the inner surface of layer 29 at the interface of layers 29 and 30, and then must traverse the entire thickness of support layer 30 to such surface 28. The advantage of the FIG. 4 structure is that the composition of layer 30 can be selected for its ability to generate seal strength in combination with its compatibility with transmitting the anti-transfer material, without any need to contain and hold a desired quantity or reserve of such anti-transfer material in interior portions of the layer. As a corollary, the composition of anti-transfer layer 29 can be selected for its beneficial properties of containing and holding a reserve quantity of such anti-transfer material, and dispensing and releasing such reserve quantity of the anti-transfer material. Indeed, some anti-transfer materials useful herein have properties corresponding to those of surfactants, which can reduce overall seal strength properties of layers wherein such materials are employed. Accordingly, where there is a concern with developing adequate seal strength in the anticipated use of the packaging structure 12, placement of the anti-transfer layer 29 outwardly in the package, of a layer 30 which provides the primary heat seal function, represents a desirable structure.

FIGS. 5–7 illustrate the principles of the embodiments of FIGS. 2–4 as applied using additional layers in the substrate structure. The embodiments of FIGS. 5–7 are specific examples of substrates which have particular application to packaging certain food products. Thus, the embodiment of FIG. 5 generally corresponds with the structure of FIG. 2 wherein the substrate comprises a polyolefin layer 32 on the outside of the structure opposite anti-transfer layer 29. A layer 34 of ethylene vinyl alcohol copolymer (EVOH) is disposed between anti-transfer layer 29 and polyolefin layer 32, as an oxygen barrier. Respective tie layers 36, 38 are disposed between the EVOH layer and the respective layers 29, 32 as extruded adhesives. The anti-transfer layer 29 is the above mentioned EVA modified according to the above teaching regarding anti-transfer material.

The embodiment of FIG. 6 corresponds with the structure of FIG. 3 wherein the substrate comprises a polyolefin layer 32 on the outside of the structure opposite anti-transfer layer 29. A layer 34 of ethylene vinyl alcohol copolymer (EVOH) is disposed between anti-transfer layer 29 and polyolefin layer 32, as an oxygen barrier. Respective tie layers 36, 38 are disposed between the EVOH layer and the respective layers 29, 32 as extruded adhesives. The anti-transfer layer 29 is the above mentioned EVA modified according to the above teaching regarding anti-transfer material, and polyolefin support layer 30 is disposed between the substrate 24 and anti-transfer layer 29.

The embodiment of FIG. 7 corresponds with the structure of FIG. 4 wherein the substrate comprises a polyolefin layer 32 on the outside of the structure opposite anti-transfer layer 29. A layer 34 of ethylene vinyl alcohol copolymer (EVOH) is disposed between anti-transfer layer 29 and polyolefin layer 32, as an oxygen barrier. Respective tie layers 36, 38 are disposed between the EVOH layer and the respective layers 29, 32 as extruded adhesives. Layer 30 has the composition of the above mentioned support layer and the modified EVA layer 29 is between substrate 24 and support layer 30.

Figure 8:
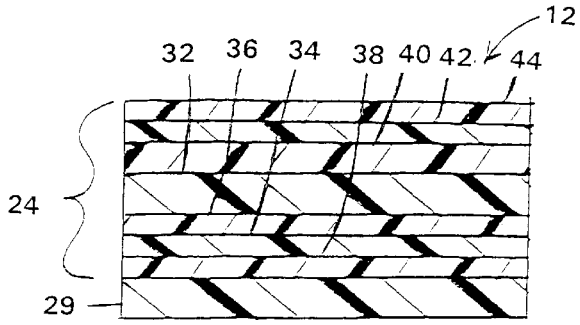
FIG. 8 shows a cross-section of a seventh, eight-layer, packaging structure of the invention incorporating the anti-transfer material.
Figure 9:
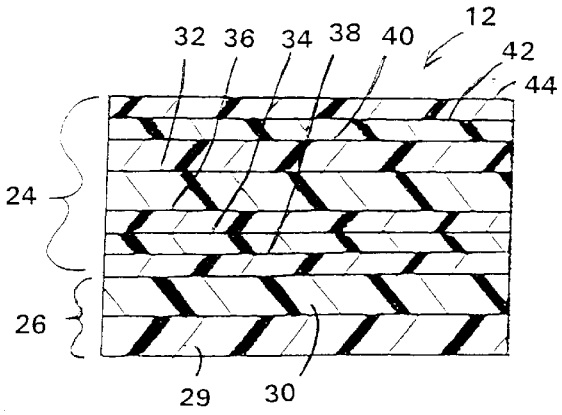
FIG. 9 shows a cross-section of an eighth, nine-layer, packaging structure of the invention incorporating the anti-transfer material.
Figure 10:
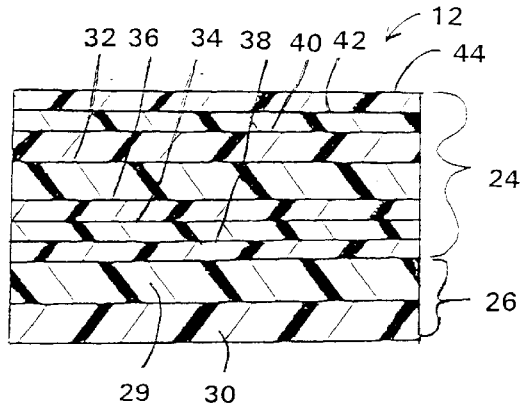
FIG. 10 shows a cross-section of a ninth, nine-layer, packaging structure of the invention incorporating the anti-transfer material.

FIGS. 8–10 illustrate the principles of the embodiments of FIGS. 2–4 in still further detail as applied using yet more complex and more specific substrate structures. Thus, the embodiment of FIG. 8 corresponds with the structure of FIG. 2 wherein the substrate comprises a polyolefin layer 32. A layer 34 of ethylene vinyl alcohol copolymer (EVOH) is disposed between anti-transfer layer 29 and polyolefin layer 32, as an oxygen barrier. Respective tie layers 36, 38 are disposed between the EVOH layer and the respective layers 29, 32 as extruded adhesives. The anti-transfer layer 29 is the above mentioned EVA modified according to the above teaching regarding anti-transfer material (MEVA). The above mentioned five layers can be fabricated simultaneously as, for example, a single five-layer coextrusion, e.g. a blown film coextrusion. Three additional substrate layers are disposed on the side of layer 32 opposite anti-transfer layer 29. Thus, an adhesive layer 40, e.g. a 2-part urethane adhesive, is disposed between polyolefin layer 32 of the coextrusion, and a layer 42 of vinylidene chloride copolymer (PVDC). On the side of the PVDC layer opposite adhesive layer 40 is a layer of oriented polyethylene terephthalate (OPET) 44. The OPET provides a good abuse resistant outer surface to the packaging structure. The PVDC provides a good adhesion surface for the urethane adhesive. PVDC is well known for its inherent properties as an oxygen barrier material in packaging films. The seal composite 26 is the anti-transfer layer 29, namely the above mentioned MEVA.

The embodiment of FIG. 9 corresponds with the structure of FIG. 3 wherein the substrate comprises a polyolefin layer 32. A layer 34 of EVOH is disposed between anti-transfer layer 29 and polyolefin layer 32, as an oxygen barrier. Respective tie layers 36, 38 are disposed between the EVOH layer and the respective layers 29, 32 as extruded adhesives. Seal composite 26 includes both anti-transfer layer 29 and suport layer 30. The anti-transfer layer 29 is the above mentioned MEVA. Polyolefin support layer 30 is disposed between tie layer 38 and anti-transfer layer 29. The above mentioned six layers 29, 30, 32, 34, 36, and 38 can be fabricated simultaneously as, for example, a single six-layer coextrusion, e.g. a blown film coextrusion. Three additional substrate layers are disposed on the side of layer 32 opposite anti-transfer layer 29. Thus, an adhesive layer 40, e.g. a 2-part urethane adhesive, is disposed between polyolefin layer 32 and a layer 42 of PVDC. On the side of the PVDC layer opposite adhesive layer 40 is a layer of OPET 44. The OPET provides good abuse resistance to the outer surface of the packaging structure. The PVDC provides a good adhesion surface for the urethane adhesive.

The embodiment of FIG. 10 corresponds with the structure of FIG. 4 wherein the substrate comprises a polyolefin layer 32. A layer 34 of EVOH is disposed between anti-transfer layer 29 and polyolefin layer 32, as an oxygen barrier. Respective tie layers 36, 38 are disposed between the EVOH layer and the respective layers 29, 32 as e.g. extruded adhesives. The seal composite 26 includes both anti-transfer layer 29 and support layer 30. The anti-transfer layer 29 is the above mentioned MEVA. Three additional substrate layers are disposed on the side of layer 32 opposite modified layer 26. Thus, an adhesive layer 40, e.g. a 2-part urethane adhesive, is disposed between polyolefin layer 32 and a layer 42 of PVDC. On the side of the PVDC layer opposite adhesive layer 40 is a layer of OPET 44. The OPET provides good abuse resistance to the outer surface of the packaging structure. The PVDC provides a good adhesion surface for the urethane adhesive. The seal layer 30 is the above mentioned support layer and the modified EVA layer 29 is between the substrate 24 and the seal layer 30. The above mentioned six layers 29, 30, 32, 34, 46, and 38 can be fabricated simultaneously as, for example, a single six-layer coextrusion, e.g. a blown film coextrusion.

EXAMPLES 1 and 2

A packaging structure 12, EXAMPLE 1, according to FIG. 8 was produced wherein the layers had the following thicknesses. OPET layer 44 was 0.5 mil thick. PVDC layer 42 was 0.1 mil thick. Urethane adhesive layer 40 was 0.15 mil thick. EVA layer 32 was 2.5 mils thick. Tie layers 36 and 38 were each 0.4 mil thick. EVOH layer 34 was 0.5 mil thick. MEVA layer 29 was 1.2 mils thick. The anti-transfer material in layer 29 was ATMER® 645 in a concentrate with NUCREL® 903 in an amount of 15 parts by weight ATMER® to 85 parts by weight NUCREL®. The concentrate was mixed with the EVA, which was 95% by weight ethylene, at the rate of 12 parts by weight concentrate to 88 parts by weight EVA to make the modified EVA composition. Accordingly, the overall fraction of ATMER modifier in the modified EVA composition (MEVA) was 1.8 percent by weight. Overall thickness of the packaging film of the EXAMPLE was 5.75 mils.

A comparative packaging structure, COMPARATIVE EXAMPLE 2, was fabricated as above except that the anti-transfer ATMER® material was omitted from anti-transfer layer 29.

Figure 11:
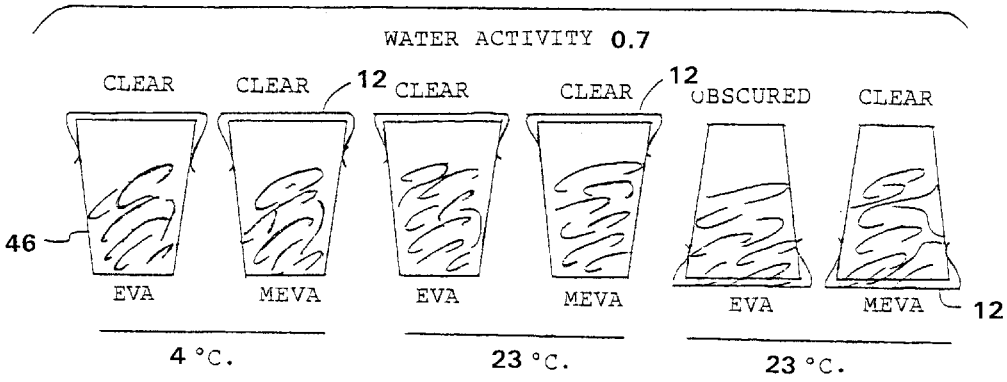
FIG. 11 illustrates a test procedure for testing a packaging structure for transfer properties discussed herein when water activity is less than 1.0.

400 gram samples of beef jerky were placed in each of six 500 milliliter glass jars illustrated as 46 in FIG. 11. The beef jerky had moisture content of 24 weight percent water. Three jars were closed and sealed with the packaging structure 12 of the example which included the MEVA layer, and three jars were closed and sealed with the comparative packaging structure which omitted the anti-transfer material, and wherein the seal layer was unmodified EVA. Inside the closed and sealed jars, the water activity of the jerky product was 0.7, namely producing a relative humidity of 70% inside the package. Correspondingly, because the relative humidity inside the closed and sealed packages was less than 100 percent, no moisture condensed on any of the packaging structures, not the structures having the MEVA layer nor the structures containing the unmodified EVA.

As indicated in FIG. 11, comparative jars were held upright at 4 degrees C. for 72 hours, whereupon the packaging structures, upon inspection, were found to be clear in both the jars having the MEVA seal material and the jars having the unmodified EVA seal material.

As indicated in FIG. 11, comparative jars were also held upright at 23 degrees C. for 72 hours, whereupon the packaging structures, upon inspection, were found to be clear in both the jars having the MEVA seal material and the jars having the unmodified EVA seal material.

Finally, as indicated in FIG. 11, comparative jars were held inverted at 23 degrees C. for 72 hours, with the product jerky resting on, physically touching, the packaging structures. At the end of the 72 hour test period, the packaging structures were placed in an upright orientation. Upon immediate inspection, the previously inverted jars were found to differ in appearance. The structure of the invention, including the MEVA layer was found to be relatively clear while the comparative structure was relatively obscured.

The inventors have reached the following conclusions from the experiments represented in FIG. 11. From the first four representations of the upright jars, the inventors conclude that the low level of water activity was insufficient to cause moisture to condense on the packaging structures. Thus, the obscuring which was observed on the comparative packaging structure on the inverted jar was not moisture condensation, but rather was product transfer material, namely extract or other components of the jerky product. Since the packaging structure in the corresponding inverted jar having the MEVA layer was clear, the inventors conclude that the MEVA composition was effective to attenuate transfer of the jerky product material from the product to the packaging structure, thereby leaving the packaging structure relatively more clear.

While choosing to not be bound by theory, the inventors herein contemplate that the mechanism of the invention operates such that anti-transfer material migrates to the interior surface 28 of the packaging structure 12 and spreads as a thin and mobile coating of anti-transfer material on the interior surface of the packaging structure 12. The surface coating interferes with the ability of the food product material to adhere to the underlying material of the inner layer of the packaging structure. If the coating material should become wiped off an area of the inner layer as the product moves about in the package during life of the package containment, the anti-transfer material remaining in or on layer 29 adjacent the wiped-off area is sufficiently mobile that the anti-transfer material migrates to the exposed area and again provides protective function at the exposed area.

Figure 12:
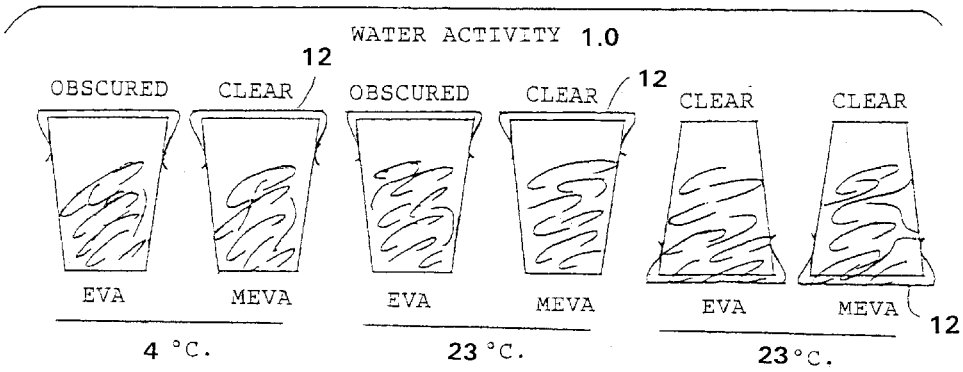
FIG. 12 illustrates a test procedure for testing a packaging structure for transfer properties discussed herein when water activity is 1.0.

As a comparison, a corresponding test is conducted wherein a product having a water activity of 1.0 is the closed and sealed in the packages. The results of the comparison test are illustrated in FIG. 12. Again, and as indicated in FIG.

12, comparative jars are held upright at 4 degrees C. for 72 hours. Upon inspection, the jar having the MEVA seal layer is found to be clear, while the jar having the unmodified EVA seal layer is obscured by moisture condensation on the packaging structure inside the jar.

Also as indicated in FIG. 12, comparative jars are also held upright at 23 degrees C. for 72 hours, whereupon the same results are observed. Namely, the jar having the MEVA seal layer is found to be clear, while the jar having the unmodified EVA seal layer is obscured by moisture condensation on the packaging structure inside the jar.

Again, and as indicated in FIG. 12, comparative jars are held inverted at 23 degrees C. for 72 hours, with the product which has a water activity of 1.0 resting on, physically touching, the packaging structures. At the end of the 72 hour test period, the packaging structures are placed in an upright orientation. Upon immediate inspection, it is found that both jars are clear.

From the combination of tests illustrated in FIGS. 11 and 12, the inventors herein conclude that, as illustrated by the upright jar samples, packages containing product which produces water activity of 1.0 are susceptible to moisture condensation on the inner surface of the packaging structure, while packages containing product which produces water activity significantly less than 1.0 are not susceptible to moisture condensation on the inner surface of the packaging structure.

As to the inverted jar samples where the product is in physical contact with the packaging material, and where the water activity is 1.0, the product contact with the packaging structure applies a thin and relatively continuous film of water on the packaging substrate whereupon the packaging substrate is observed as clear both with the MEVA layer and with the unmodified EVA layer. By contrast, where the product is sufficiently dry that no continuous film of water is applied on the packaging structure by the product, the packaging structure having the unmodified EVA is obscured by material transferred from the product to the packaging structure, while the MEVA protects the packaging structures, in which MEVA is used, against such obscuring product transfer and retains the packaging structure in a clear condition in a water activity environment of less than 1.0.

In any of the above structures, any of the commercially available EVOH copolymers can be used, depending on the specific needs for the properties to be provided by the EVOH. Two such resins found acceptable are SOARNOL® ET EVOH resin available from SOARUS, LLC., Arlington Heights, Ill. and EVAL® H101B EVOH resin available from EVALCA, Lisle, Ill.

The compositions of the tie layers can be any of the polymers known for good adhesion to EVOH, for example maleic anhydride modified olefin polymers. One such resin is TYMOR® 1203 resin available from Rohm and Haas, Philadelphia, Pa. Another tie resin is designated as BYNEL® 41E687 available from DuPont Company, Wilmington, Del. Such polymers are well known for their adhesion to EVOH polymers and thus need not be further described here.

As suggested above, the upper and lower structures 16, 18 are preferably the same, each as the other. However, the upper and lower structures can differ both as to structure and composition. Thus, the configuration of structure 16 can be different from the configuration of structure 18. Correspondingly, irrespective of whether the configurations are the same or different, the compositions can be different. Particularly, the anti-transfer material contents of the upper and lower structures can be different. For example, where the upper structure has a transparent window and the lower structure has no such transparent window, one can specify that only the upper structure has the anti-transfer additive. For example, where both structures have windows, but differ in configuration, the fractional amount of anti-transfer material additive in the respective layers of the respective upper and lower structures can differ according to the configurational differences.

Any of the structures of the invention can have the usual known applications of ink and/or other decorative or imaging materials which convey both advertising messages and information about the contained product.

While the above packaging has been described within the context of packaging jerky, a variety of other products having water activities less than 1.0 can be so packaged with similar benefit, where an extract or other portion of the product would otherwise transfer to the packaging structure and thereby adversely affect the appearance of the package. Thus, the packaging materials described herein are effective to protect packaging structure from the visual effects of transfer of food extract from a wide range of dry and semi-dry food products having water activities of about 0.4 to about 0.95, preferably about 0.5 to about 0.8, more preferably about 0.65 to about 0.75.

A preferred method of fabricating the packaging structure is to coextrude as many layers as possible. Thus, one can coextrude layers 29, 32, 34, 36, and 38 as a five layer structure, or layers 29, 30, 32, 34, 36, and 38 as a six layer structure. In such coextrusions, the composition of layer 32 can be any polyolefin which can be coextruded with the other materials in the structure and which can be bonded to PVDC layer 42, or another material used in place of the PVDC, with suitable adhesion. In the illustrated embodiments, the layer of PVDC 42 is emulsion coated onto a previously-fabricated layer of OPET 44 to make a two-layer composite. The two layer composite is then adhesively laminated to the 5-layer or 6-layer coextrusion at layer 32 using a 2-part urethane adhesive which becomes layer 40, resulting in the 8-layer, or 9-layer, packaging structures illustrated in e.g. FIGS. 8 and 9. In such structures, the substrate 24, as used herein, includes all layers except seal composite layer 29, and layer 30 where used.

In place of any of the OPET layers described here, a variety of other abuse resistant layers can be used.

As illustrated in the above examples, structures of the invention can well be thought of in terms of a substrate 24 and a seal composite 26. The seal composite includes an anti-transfer layer 29, and may or may not include one or more additional layers such as support layer 30. The substrate includes at least 1 polymeric layer, and typically includes 2 or more polymeric layers.

While the anti-transfer layer of the invention has been described in combination with a packaged jerky product, benefit can be obtained with any product which holds potential of transferring visually impairing or obscuring material to an otherwise-transparent area of the package structure, and wherein the water activity inside the closed and sealed package is less than 1. Thus, a wide range of packaging structures are contemplated for use in the invention. Where less abusive use environments are contemplated, the packaging structure can be as thin as about 1.5 mils to about 2.5 mils. Where a more abusive use environment is expected, a thicker packaging structure is used, such as about 3.5 mils thick to about 8 mils thick. Typically, in an abusive food packaging environment such as jerky, overall thickness of the packaging structure is about 4 mils to about 5.5 mils, with a preferred thickness of about 5 mils.

EXAMPLES 3–5

Table 2 shows layer thicknesses of exemplary structures of the invention, for three packaging structures, each 5.75 mils thick, wherein layers 40, 42, and 44 represent about 0.75 mil of the overall thickness and the coextruded structure represents the remaining 5 mils of the overall thickness. Thickness is expressed first as mils absolute thickness, followed by weight percent of the coextruded structure for those layers which are comprising the coextruded structure.

EXAMPLE 3 uses the MEVA anti-transfer layer without a support layer 30. EXAMPLE 4 includes a support layer 30 of linear low density polyethylene such as ExxonMobil Exceed 350D60. EXAMPLE 5 includes a support layer 30 of linear low density polyethylene such as ExxonMobil Exceed 350D60. In each case, the EMAA concentrate contains 15% by weight of the above Atmer modifier, and the concentrate is about 12 percent by weight of the composition of layer 29.

TABLE 2

| | Substrate 24 | | | | | | | Seal Composite 26 | |
|---|---|---|---|---|---|---|---|---|---|
| Ex No. | OPET Layer 44 | PVDC Layer 42 | Adh Layer 40 | PE Layer 32 | Tie Layer 36 | EVOH Layer 34 | Tie Layer 38 | Support Layer 30 | MEVA Layer 29 |
| 3 | 0.5 | 0.1 | 0.15 | 2.0/40% | 0.3/6% | 0.5/10% | 0.3/6% | — | 1.9/38% |
| 4 | 0.5 | 0.1 | 0.15 | 1.3/26% | .25/5% | 0.6/12% | .25/5% | 1.3/26% | 1.3/26% |
| 5 | 0.5 | 0.1 | 0.15 | .83/17% | .17/3% | .49/10% | .17/3% | 1.0/21% | 2.3/46% |

In preferred structures, especially where 5 or more layers are formed by coextrusion, the e.g. PE layer 32 opposite the seal composite 26 is preferably substantially thinner than seal composite 26. Thus, in preferred structures, layer 32 represents about 16 percent by weight up to about 33 percent by weight of the coextruded structure. In some preferred embodiments, layer 32, as an outside layer of the coextrusion, represents about 16 weight percent to about 20 weight percent of the coextruded structure. In other embodiments, layer 32 represents about 24 weight percent to about 28 weight percent of the coextruded structure.

In cooperating combination with the preferred quantities of layer 32, seal composite 26 preferably includes about 50 weight percent to about 70 weight percent of the coextruded structure. In some preferred embodiments, the seal composite includes about 65 weight percent to about 70 weight percent of the coextruded structure, and layer 32 includes about 16 weight percent to about 20 weight percent of the coextruded structure. In other embodiments, the seal composite includes about 50 weight percent to about 55 weight percent of the coextruded structure, and layer 32 includes about 24 weight percent to about 28 weight percent of the coextruded structure.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A closed and sealed package having an outer surface and an inner surface, and a product-receiving cavity disposed inwardly of the inner surface, said closed and sealed package comprising:

(a) a flexible packaging structure comprising at least two layers and defining a closed and sealed containment structure, said flexible packaging structure having inner and outer packaging structure surfaces corresponding to the inner and outer surfaces of the closed and sealed package and comprising (i) a substrate comprising one or more layers of polymeric material, including a layer of oxygen barrier material, and (ii) an anti-transfer layer comprising a film-forming polymeric composition containing at least about 0.4 percent by weight of an anti-transfer material; and (b) a contained food product, in the cavity, the food product having a water activity in the closed and sealed package of about 0.4 to 0.95 whereby relative humidity inside the package is less than 100 percent, and whereby water does not condense onto the inner surface of the package, the food product having a tendency to deposit, by physical contact with the inner surface of said flexible packaging structure, a visually obscuring food product component thereof, other than water condensation, on the inner surface of said flexible packaging structure, the anti-transfer material being effective in the flexible packaging structure, upon contact of the food product with the packaging structure, to attenuate the visually obscuring effect of the visually obscuring component of the food product.

2. A closed and sealed package as in claim 1, said anti-transfer material being dispersed within the composition of said anti-transfer layer.

3. A closed and sealed package as in claim 1 wherein said anti-transfer material is selected from the group consisting of primary alcohols having molecular weight greater than 200, polyethylene glycol, polypropylene glycol, glycerol, ethoxylated alcohols, glycerol monostearate, glycerol monooleate, esters of adipic acid, sorbitan monolaurate, sorbitan monooleate, ethoxylated sorbitan monolaurate, cocoamine, tallow amine, stearyl amine, ethoxylated stearyl amine, microcrystalline wax, carnauba wax, montan ester waxes, poly(dimethyl siloxane), and polyethylene having molecular weight less than 4000.

4. A closed and sealed package as in claim 1 wherein said anti-transfer layer is comprised in a seal composite, which seal composite is comprised in a coextruded film also defining at least part of said substrate of said flexible packaging structure, said seal composite comprising about 50 percent by weight to about 70 percent by weight of said coextruded film.

5. A closed and sealed package as in claim 4, said coextruded film being about 3.5 mils thick to about 8 mils thick.

6. A closed and sealed package as in claim 1, said anti-transfer material comprising a short chain fatty acid or fatty acid derivative having a 12-carbon to 22-carbon chain.

7. A closed and sealed package as in claim 1, said anti-transfer material being dispersed in said anti-transfer layer, and being operative to migrate from within said anti-transfer layer to the inner surface of said flexible packaging structure and to form an effectively protective coating on the inner surface of said flexible packaging structure.

8. A closed and sealed package as in claim 1 wherein said anti-transfer layer comprises ethylene vinyl acetate copolymer as a primary polymer.

9. A closed and sealed package as in claim 1 wherein said anti-transfer layer is comprised in a seal composite, wherein a primary polymer in said anti-transfer layer comprises ethylene vinyl acetate copolymer and wherein said seal composite further comprises a second layer comprising a second different ethylene-based polymer composition and wherein said second layer of said seal composite is tougher than said anti-transfer layer.

10. A closed and sealed package as in claim 1 wherein said anti-transfer material is effective to attenuate a visually obscuring effect of at least one of fat and sugar at water activity of about 0.4 to about 0.95.

11. A closed and sealed package as in claim 1 wherein said anti-transfer layer defines the inner surface of said flexible packaging structure at the cavity.

12. A closed and sealed package as in claim 1 wherein said flexible packaging structure bears printing which indicates contents defining dried meat product.

13. A closed and sealed package as in claim 1 wherein said flexible packaging structure bears printing which indicates contents defining jerky product.

14. A closed and sealed package as in claim 1 wherein said flexible packaging structure bears printing which indicates contents defining beef jerky product.

15. A closed and sealed package as in claim 1 wherein the contained food product has a water activity in the closed and sealed package of about 0.5 to about 0.8.

16. A method of packaging a food product, comprising:

(a) providing, for packaging, a food product having a water activity in a closed and sealed package, of about 0.4 to 0.95; and (b) packaging the food product in a closed and sealed package comprising a flexible packaging structure, the closed and sealed package having an outer surface and an inner surface, and a product-receiving cavity disposed inwardly of the inner surface, the flexible packaging structure comprising at least two layers and including (i) a substrate comprising one or more layers of polymeric material, including a layer of oxygen barrier material, and (ii) an anti-transfer layer comprising a film-forming polymeric composition containing about 0.4 percent by weight to about 3 percent by weight of an anti-transfer material within the composition of the anti-transfer layer, the food product in the cavity having a water activity in the closed and sealed package of about 0.4 to about 0.95 whereby relative humidity inside the package is less than 100 percent, and whereby water does not condense onto the inner surface of the package, the food product having a tendency to deposit, by physical contact with the inner surface of the flexible packaging structure, a visually obscuring food product component thereof, other than water condensation, on the inner surface of the flexible packaging structure, the anti-transfer layer being disposed between the substrate and the cavity, the anti-transfer material being effective in the flexible packaging structure, upon contact with the food product, to attenuate the visually obscuring effect of the visually obscuring component of the food product.

17. A method as in claim 6, including selecting the anti-transfer material from the group consisting of primary alcohols having molecular weight greater than 200, polyethylene glycol, polypropylene glycol, glycerol, ethoxylated alcohols, glycerol monostearate, glycerol monooleate, esters of adipic acid, sorbitan monolaurate, sorbitan monooleate, ethoxylated sorbitan monolaurate, cocoamine, tallow amine, stearyl amine, ethoxylated stearyl amine, microcrystalline wax, carnauba wax, montan ester waxes, poly(dimethyl siloxane), and polyethylene having molecular weight less than 4000.

18. A method as in claim 6, including dispersing the anti-transfer material in the anti-transfer layer, and wherein the anti-transfer material is operative to migrate from within the anti-transfer layer to an interior surface of the closed and sealed package.

19. A method as in claim 16, including printing the flexible packaging structure to indicate contents defining dried meat product.

20. A closed and sealed package, having an outer surface and an inner surface, and a product-receiving cavity disposed inwardly of the inner surface, said closed and sealed package comprising:

(a) a flexible packaging structure comprising at least two layers and defining a closed and sealed containment structure having inner and outer surfaces corresponding to the inner and outer surfaces of the closed and sealed package, said flexible packaging structure comprising (i) a substrate comprising one or more layers of polymeric material and (ii) an anti-transfer layer comprising a film-forming polymeric composition containing about 0.4 percent by weight to about 3 percent by weight of an anti-transfer material, said flexible packaging material bearing printing indicating contents defining dried food product; and (b) a contained dried food product in the cavity, the dried food product having a water activity in the closed and sealed package of no more than 0.95 whereby relative humidity inside the package is less than 100 percent, and whereby water does not condense on the inner surface of the package, the food product having a tendency to deposit, by physical contact with the inner surface of said flexible packaging structure, a visually obscuring food product component thereof, other than water condensation, on the inner surface of said closed and sealed package, the anti-transfer material being effective in the flexible packaging structure, upon contact of the food product with the packaging structure, to attenuate the visually obscuring effect of the visually obscuring component of the food product.

21. A closed and sealed package as in claim 20 wherein the contained food product has a water activity in the closed and sealed package of about 0.5 to about 0.8.

22. A closed and sealed package as in claim 20 wherein said flexible packaging structure bears printing indicating contents defining jerky product.

23. A closed and sealed package as in claim 20 wherein said flexible packaging structure bears printing indicating contents defining beef jerky product.

24. A closed and sealed package as in claim 20 wherein said anti-transfer material is selected from the group consisting of primary alcohols having molecular weight greater than 200, polyethylene glycol, polypropylene glycol, glycerol, ethoxylated alcohols, glycerol monostearate, glycerol monooleate, esters of adipic acid, sorbitan monolaurate, sorbitan monooleate, ethoxylated sorbitan monolaurate, cocoamine, tallow amine, stearyl amine, ethoxylated stearyl amine, microcrystalline wax, carnauba wax, montan ester waxes, poly(dimethyl siloxane), and polyethylene having molecular weight less than 4000.

25. A closed and sealed package as in claim 20 wherein said anti-transfer layer comprises ethylene vinyl acetate copolymer as a primary polymer.

26. A closed and sealed package as in claim 20 wherein said anti-transfer layer is comprised in a seal composite, wherein a primary polymer in said anti-transfer layer comprises ethylene vinyl acetate copolymer and wherein said seal composite further comprises a second layer comprising a second different ethylene-based polymer composition and wherein said second layer of said seal composite is tougher than said anti-transfer layer.

* * * * *